US006605164B2

(12) United States Patent
Kennedy et al.

(10) Patent No.: US 6,605,164 B2
(45) Date of Patent: Aug. 12, 2003

(54) NICKEL-BASED ALLOY HAVING HIGH STRESS RUPTURE LIFE

(75) Inventors: Richard L. Kennedy, Monroe, NC (US); Wei-Di Cao, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 09/844,696

(22) Filed: Apr. 30, 2001

(65) Prior Publication Data

US 2002/0036037 A1 Mar. 28, 2002

Related U.S. Application Data

(63) Continuation of application No. 08/264,944, filed on Jun. 24, 1994, now abandoned.

(51) Int. Cl.[7] ..... C22C 19/05

(52) U.S. Cl. ..... 148/410; 420/448

(58) Field of Search ..... 420/448; 148/410, 148/428

(56) References Cited

U.S. PATENT DOCUMENTS

| | | | |
|---|---|---|---|
| 3,046,108 | A | 7/1962 | Eiselstein |
| 3,660,177 | A | 5/1972 | Brown et al. |
| 4,400,211 | A | 8/1983 | Kudo et al. |
| 4,888,253 | A | 12/1989 | Snyder et al. |

OTHER PUBLICATIONS

"Heat Treating of Nickel and Nickel Alloys", ASM Handbook vol. 4: Heat Treating, pub. by ASM International, 1991, p. 911.*

Impurities and Trace Elements in Nickel–Base Superalloys; R.T. Holt and W. Wallace; Review 203; pp. 1–24; Mar. 1976.

Effect of Phosphorus on the Microstructure and Stress Rupture Properties in an Fe–Ni–Cr Base Superalloy; W.R. Sun, S.R. Guo, D.Z. Lu and Z.Q. Hu; vol. 28A; Mar. 1997.

Effect of Minor Elements on Microstructure and Mechanical Properties; Shouren Guo, Wenru Sun, Dezhong Lu and Zhuangqi Hu; Institute of Metal Research; Shenyang 110015, China; 1997; pp. 521–530.

Segregation Behavior of Phosphorus and Its Effect on Microstructure and Mechanical Properties in Alloy System Ni–Cr–Fe–Mo–Nb–Ti–Al ; Xishan Xie, Xingbo Liu, Jianxin Dong, Yaohe Hu and Zhichao Xu; University of Science and Technology Beijing, Beijing 100083, China; 1997; pp. 531–542.

The Role of Phosphorus and Sulfur in Inconel 718; Xishan Xie, Xingbo Liu, Yaohe Hu, Bin Tang, Zhichao Xu, Jianxin Dong and Kequan Ni; University of Science & Technology Beijing, Beijing 100083, China; 1996; pp. 599–606.

Stress–Rupture Strength of Alloy 718; Richard J. Kennedy, Wei–Di Cao and William M. Thomas; Teledyne Allvac, Monroe, N.C. ; Advanced Materials & Processes 3/96; pp. 33–35.

Phosphorus–Boron Interaction in Nickel–Base Superalloys; W.D. Cao and R.L. Kennedy; Teledyne Allvac, Monroe, NC; 1996; pp. 589–596.

The Effect of Phosphorous on Mechanical Properties of Alloy 718; Wei–Di Cao and Richard L. Kennedy; Teledyne Allvac, Monroe, NC; 1994; pp. 463–477.

* cited by examiner

*Primary Examiner*—Roy King
*Assistant Examiner*—Harry D. Wilkins, III
(74) *Attorney, Agent, or Firm*—Shoemaker and Mattare

(57) ABSTRACT

A nickel-based fine grained alloy consisting essentially of 40–55 wt % Ni, 14.5–21 wt % Cr, 2.5–5.5 wt % Nb+Ta, up to 3.3 wt % Mo, 0.65–2.00 wt % Ti, 0.10–0.8 wt % Al, up to 0.35 wt % Mn, up to 0.07 wt % C, up to 0.015 wt % S, up to 0.35 wt % Si, at least 0.016 wt % P, from 0.003 % to 0.030 wt % B, and the balance Fe and incidental impurities, has a high stress rupture life.

2 Claims, 6 Drawing Sheets

NICKEL-BASED ALLOY HAVING HIGH STRESS RUPTURE LIFE

This application is a continuation of application Ser. No. 08/264,944, filed Jun. 24, 1994 now abandoned.

FIELD OF THE INVENTION

The present invention relates in general to improvements in nickel-based superalloys and more particularly to compositions and methods for improving the creep resistance of such alloys at specific preselected temperatures.

BACKGROUND OF THE INVENTION

Exemplary of nickel-based superalloys is alloy 718 which has a composition specification, according to the Society of Automotive Engineering and Aerospace Material Specification AMS5662E of 50–55 wt % Ni, 17–21 wt % Cr, 4.75–5.50 wt. % Nb+Ta, 2.8–3.3 wt % Mo, 0.65–1.15 wt % Ti, 0.2–0.8 wt % Al, 0.35 wt % Mn (max.), 0.08 wt % C (max), 0.015 wt % S (max), 0.015 wt % phosphorus (max), 0.015 wt % Si (max), 1.00 wt % Co (max), 0.006 wt % boron (max), 0.30 wt % Cu (max), with the balance Fe.

The nominal composition of the alloy is 53 wt % Ni, 18.0 wt % Cr, 18.5 wt % FE, 5.2 wt % Nb (and Ta), 3.0 wt % Mo, 1.00 wt % Ti, 0.50 wt % Al, 0.04 wt % carbon, and 0.004 wt % boron with phosphorus in the range of 0.005–0.009 wt % or 50–90 ppm. This alloy is a precipitation hardened nickel-base alloy with excellent strength, ductility and toughness throughout the temperature range −423° F. to +1300° F. The alloy is normally provided in both cast and wrought forms and typical end use parts, such as, blades, discs, cases and fasteners are characterized by high resistance to creep deformation at temperatures up to 1300° F. (705° C.) and by oxidation resistance up to 1800° F. (908° C.). In particular, parts which are formed or welded and then precipitation hardened develop the desired properties. These properties, along with oxidation resistance, good weldability and formability, account for its wide use in aerospace, nuclear and commercial applications.

It is well known, as in U.S. Pat. No. 3,660,177, that the fatigue resistant properties of the alloy can be substantially improved by adjusting the processing practice in ways that promote the formation of ultra fine grain size. Unfortunately, the formation of ultra fine grain size and its beneficial effect on fatigue properties is accompanied by an unwanted reduction in stress rupture properties or creep resistance at preselected test temperatures. It is therefore desirable to provide an improved alloy which exhibits better stress rupture life while maintaining a constant ultra-fine grain size and therefore fatigue resistance comparable to conventional 718 alloy.

SUMMARY OF THE INVENTION

An objective of the present invention is to improve the creep resistance of nickel-based alloys while maintaining a constant ultra-fine grain size and other desired properties, such as fatigue resistance.

The stress rupture life of fine-grained nickel-based alloys is improved at certain temperatures and stresses by the synergistic effect of predetermined amounts of phosphorus (P) and boron (B) in the alloy composition and more particularly in such alloys having low carbon content.

The element boron by itself, or in combination with zirconium has in the past been purposely added to nickel-based alloys for the purpose of improving stress rupture and creep properties. Phosphorus, on the other hand, is considered a "tramp" element—that is, it is not purposely added, but carried in as a contaminant with various raw materials used to produce nickel-based alloys and has generally been considered as detrimental to properties if the content is allowed to exceed very low limits. Most commercial specifications for nickel-based alloys place a low maximum limit on phosphorus content. Specification AMS 5662E, for example, restricts phosphorus to 0.015% maximum.

It has been discovered however, that purposeful additions of phosphorus, even in excess of the nominal commercial specification limits, can surprisingly improve the stress rupture properties of certain nickel-base superalloys by as much as an order of magnitude (10×) or 1000%.

It has further been discovered that specific amounts of phosphorus, boron, and carbon in nickel-base alloys work together in a synergistic manner and that when all three elements are present in specific, controlled amounts, that even greater improvements in stress rupture properties can be obtained. These results are obtained with values that are more than additive of the results expected of each element individually. This synergistic effect is achieved while maintaining other desired properties such as tensile strength and fatigue resistance.

The desired effect of phosphorus and boron on stress rupture or creep deformation of superalloys according to the invention described herein, can best be understood from the following discussion. The controlling mechanism of creep deformation in most applications in nickel-based superalloys, particularly the alloys described herein, is dislocation creep which can occur at grain boundaries and the interior of the grains. Phosphorus and boron in nickel-based alloys have a strong tendency to segregate to grain boundaries and also remain inside the grains as solute atoms or as compounds (phosphides or borides), particularly when the grain boundaries are heavily occupied by phosphorus or boron. Usually phosphorus and boron will compete with each other for available grain boundary sites and phosphorus in this side competition has a stronger tendency to grain boundary segregation. At lower test temperatures, as described herein, transgranular dislocation creep dominates. Phosphorus and boron which remain in the interior of grains can retard creep deformation by their interaction with dislocations through several possible mechanisms, and a strong synergistic effect of phosphorus and boron on dislocation creep was observed, as more fully described hereinafter. However, phosphorus and boron which segregate to grain boundaries will not play any important role in retarding the transgranular dislocation creep. This may explain the lack of any observed effect of boron at low levels in alloys with ultra low phosphorus. That is, boron preferentially segregates to the grain boundaries, due to lack of site competition from phosphorus.

The synergistic effect described and the roles of varying amounts of phosphorus, boron and carbon in nickel-based alloys in improving stress rupture properties without detrimentally affecting fatigue life was characterized in the results of a systematic series of comparison tests described hereinafter.

DETAILED DESCRIPTION OF THE INVENTION

A number of test alloys were prepared by the usual manufacturing method. Fifty pound heats were vacuum induction plus vacuum die melted. Following a homogenization treatment, all ingots were rolled to 0.625" diameter bar and heat treated with a standard solution+aging treatment of 1750° F./1 HR/AC+1325° F./8 HRS/FC. Phosphorus, boron and carbon contents were varied in different heats but all of their chemistry and processing conditions were held constant.

Phosphorus Effect

Figure 1:
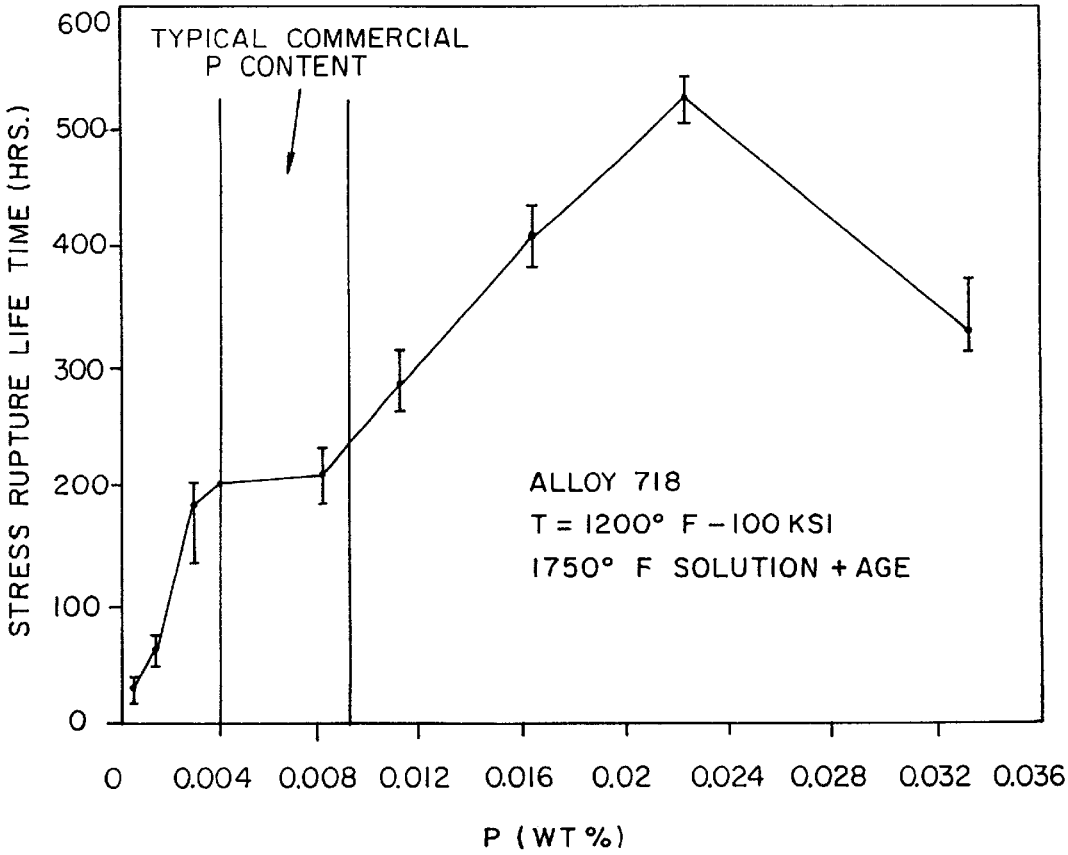
FIG. 1 is a graphical representation of the effect on stress rupture life of changes in the phosphorus content of alloy 718 of nominal alloy composition with standard-heat treatment, tested at a temperature of 1200° F. and a loading of 100 Ksi, with the nominal phosphorus composition range shown cross-hatched.

The effects of varying only phosphorus over a very wide range, e.g. much greater than defined in most specifications, on the mechanical properties of a nominal 718 alloy are presented in Table 1 and FIG. 1. The tests demonstrated that increasing phosphorus up to a level much higher than the maximum allowed in most specifications, and certainly much higher than current commercial practice, significantly improved the stress rupture properties of alloy 718. When compared to the alloy with phosphorus content typical of normal commercial 718, an increase of more than 2.5× was achieved at a phosphorus content of 0.022% over the entire range of phosphorus levels studied, an increase in rupture life of more than 10× was observed. The desirable high levels of phosphorus had no significant effect on stress rupture ductility compared to standard 718. Tensile strengths at both room temperature and 1200° F. were not effected by phosphorus content while tensile ductilities were unchanged or slightly improved (at 1200° F.).

The stress rupture life improvements noted were grain size dependent and showed up most significantly in fine grained structures. It is well known that fine grained 718 has excellent fatigue properties but relatively inferior creep and stress rupture resistance. This study showed that the drawback of fine grained 718 could be overcome by increasing the phosphorus level, leading to a new type of nickel-based alloy which has both excellent fatigue resistance and outstanding creep/stress rupture properties.

Increased phosphorus levels enhanced the resistance to intergranular cracking of alloy 718, as shown by the transition of fracture mode from intergranular to transgranular separation in stress rupture tests at lower stresses. This effect is probably related to increased phosphorus segregation to grain boundaries.

Phosphorus-boron Interaction

Figure 2:
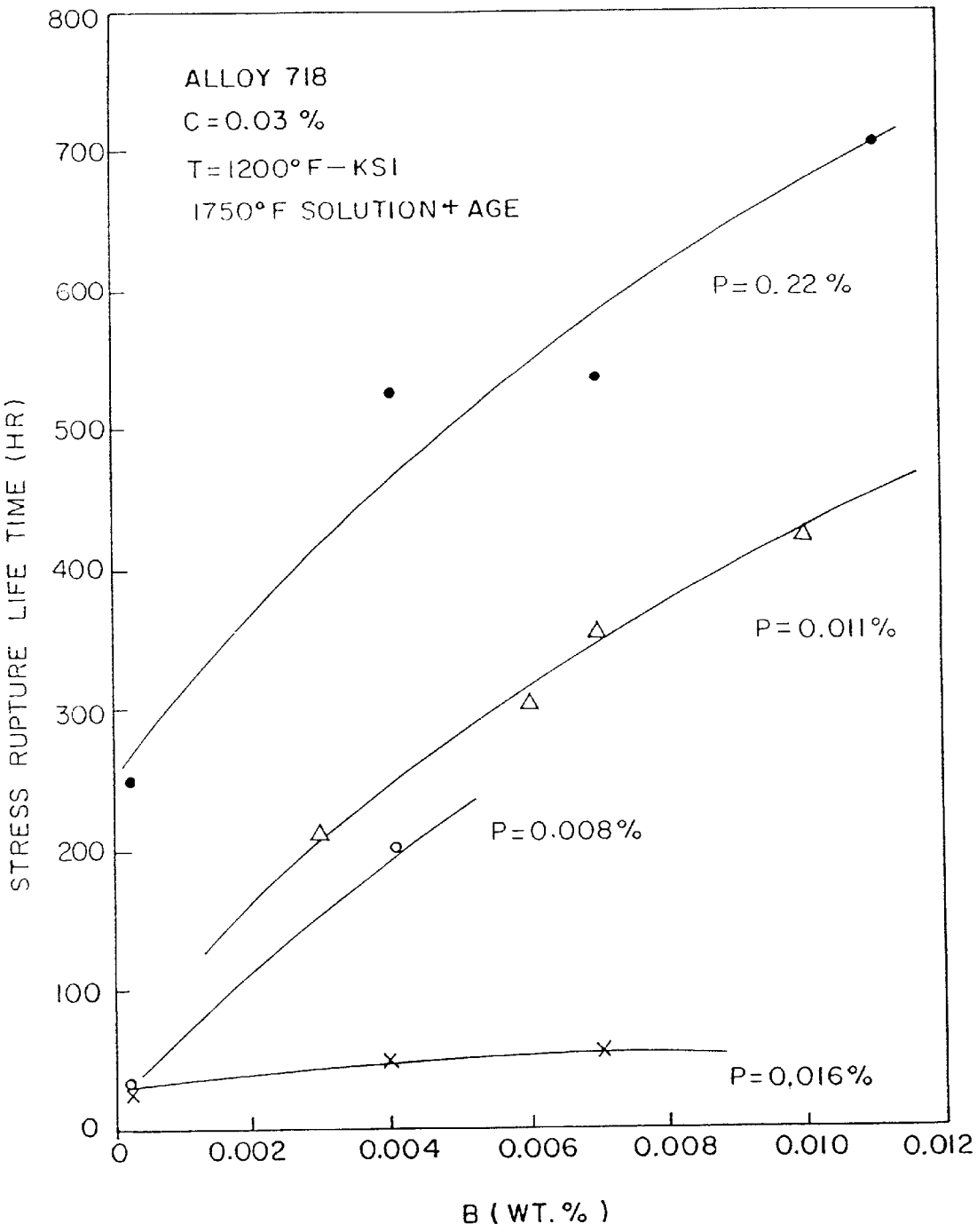
FIG. 2 is a series of line graphs showing the effect on stress rupture life of various percentages by weight of boron at various percentages by weight of phosphorus at a single percentage by weight of carbon, tested at a temperature 1200° F.

The interactive effects of phosphorus and boron on stress rupture properties are shown in Table 1 and FIG. 2. FIG. 2 illustrates that rupture life increases as the boron content is raised. Surprisingly, however, these data also show that boron has no effect on rupture life if the phosphorus content is at a very low level (0.016%). This suggests a very strong interaction effect between phosphorus and boron which has not been recognized previously.

Figure 3:
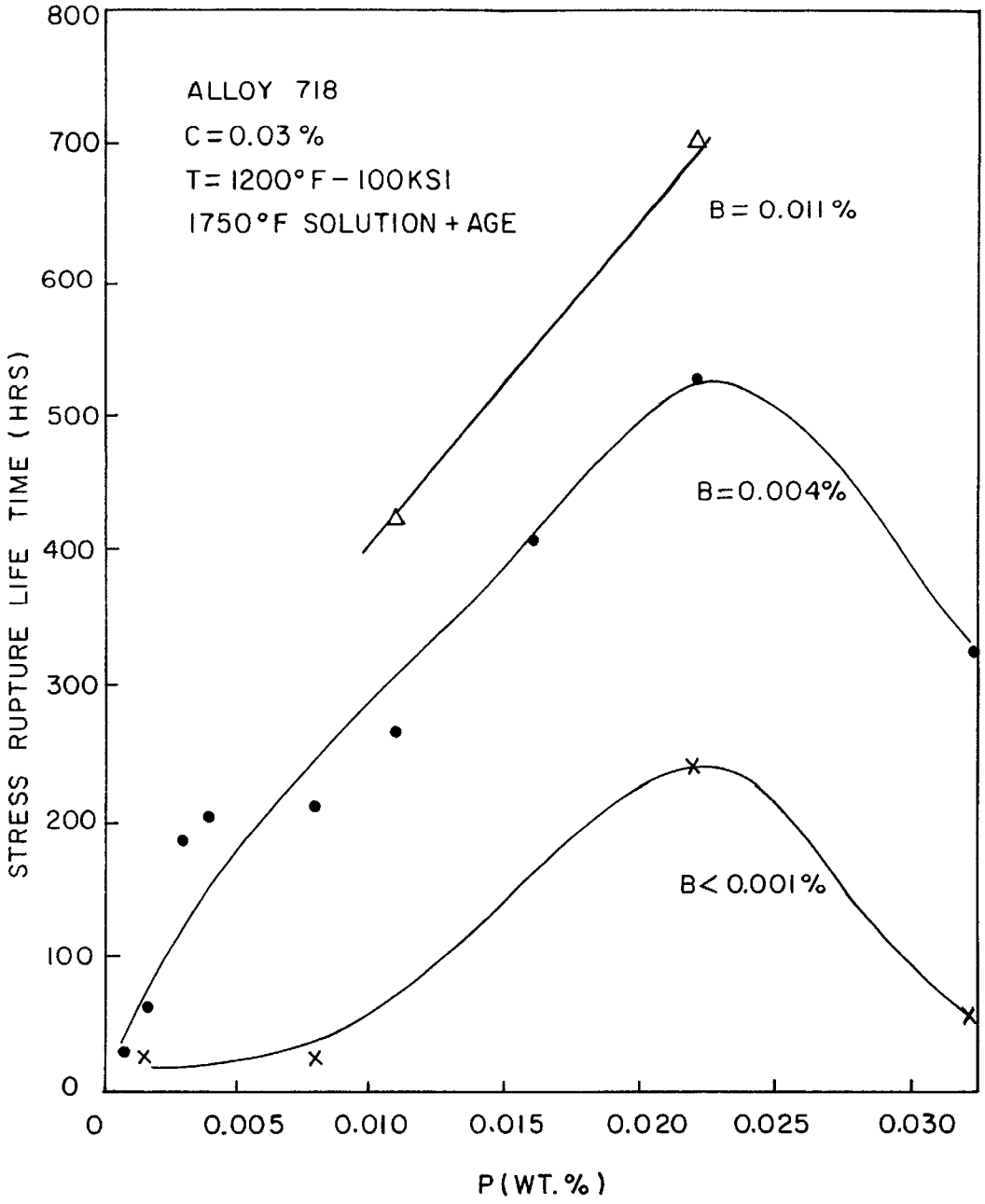
FIG. 3 is a series of line graphs showing the effect on stress rupture life of various percentages by weight of phosphorus at various percentages by weight of boron at a single percentage by wt. of carbon and tested at a temperature of 1200° F. and a loading of 100 ksi.

To a slightly lesser degree the reverse effect is also true. As shown in FIG. 3, at very low levels of boron, phosphorus has a smaller effect on rupture life than at higher boron levels.

Figure 4:
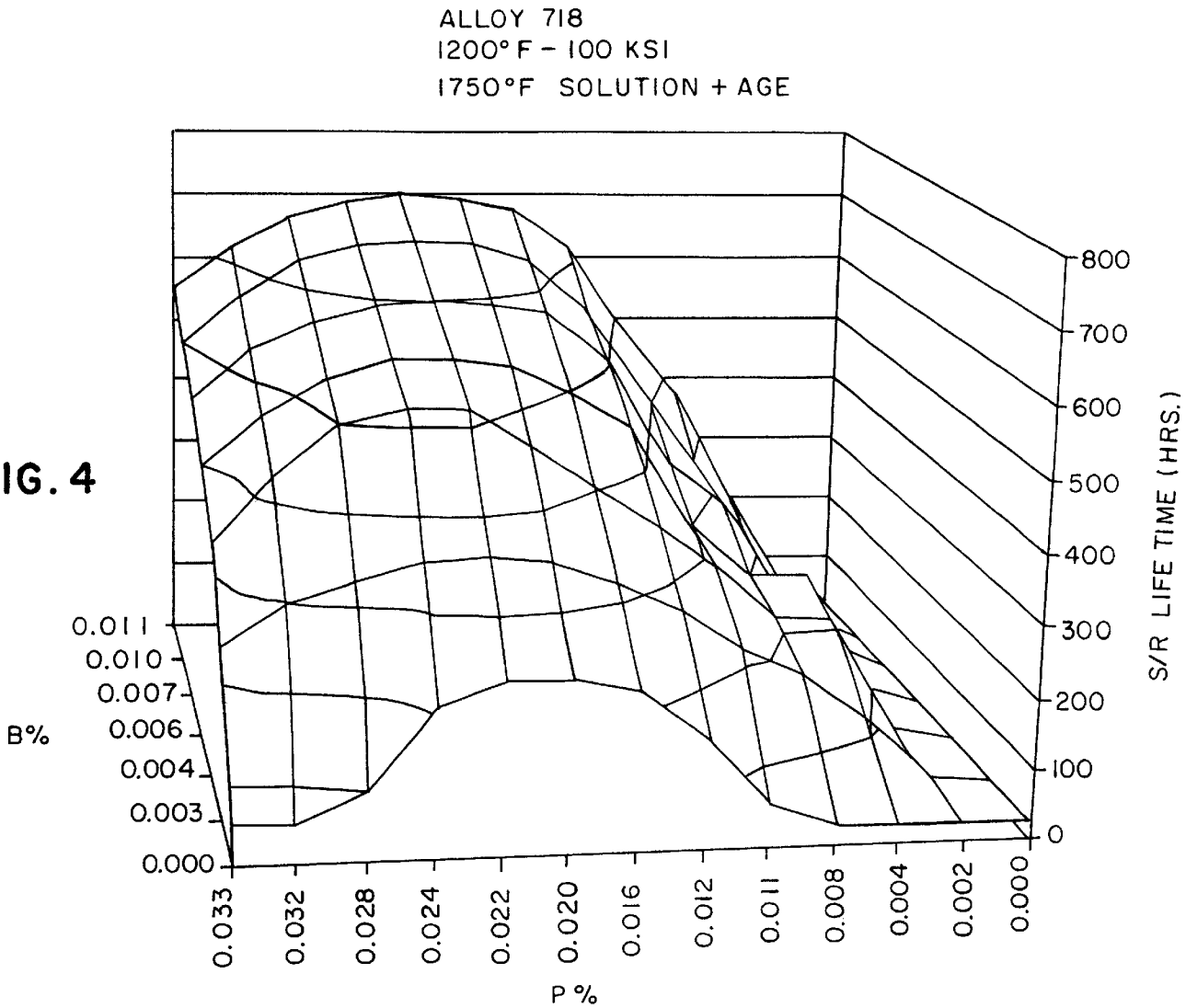
FIG. 4 is a three-axis graphical representation of the effect on stress rupture life of varying amounts of phosphorus and boron in nickel-based alloy 718 having a predetermined carbon content, tested at 1200° F. and a load of 100 Ksi.

The synergistic interaction between phosphorus and boron on rupture life can best be seen when examined as a three dimensional plot shown in FIG. 4. This plot clearly shows that the longest stress rupture lives are achieved when both phosphorus and boron are present in certain critical amounts. It is also evident from FIGS. 2 to 4 that the maximum rupture life hours are greater than the sum expected from each of these elements acting independently, an unexpected synergistic effect.

Carbon Effect

Figure 5:
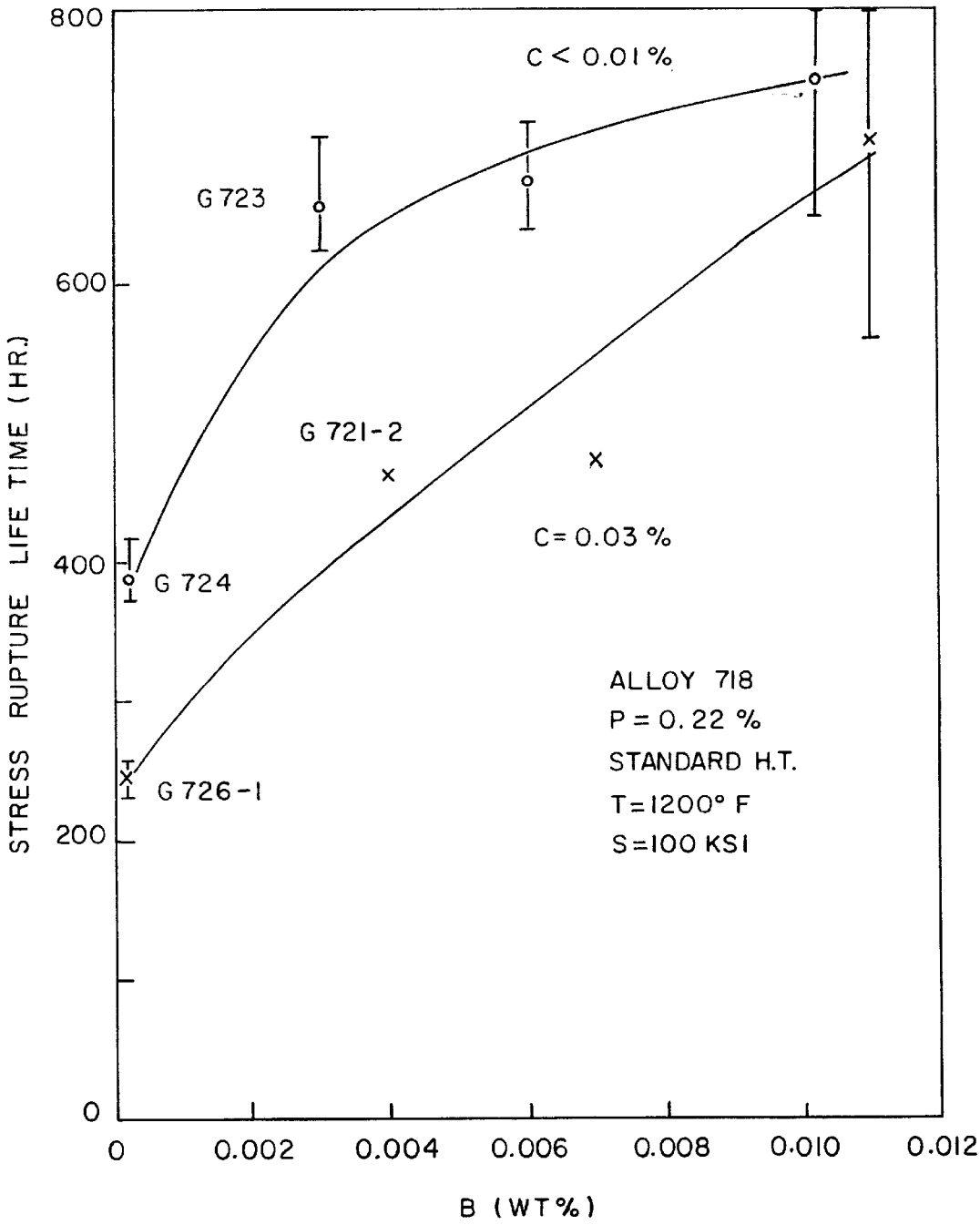
FIG. 5 is a graph showing the effect on stress rupture life of varying amounts of boron in alloy 718 at fixed concentrations of phosphorus and carbon at the test conditions indicated.
Figure 6:
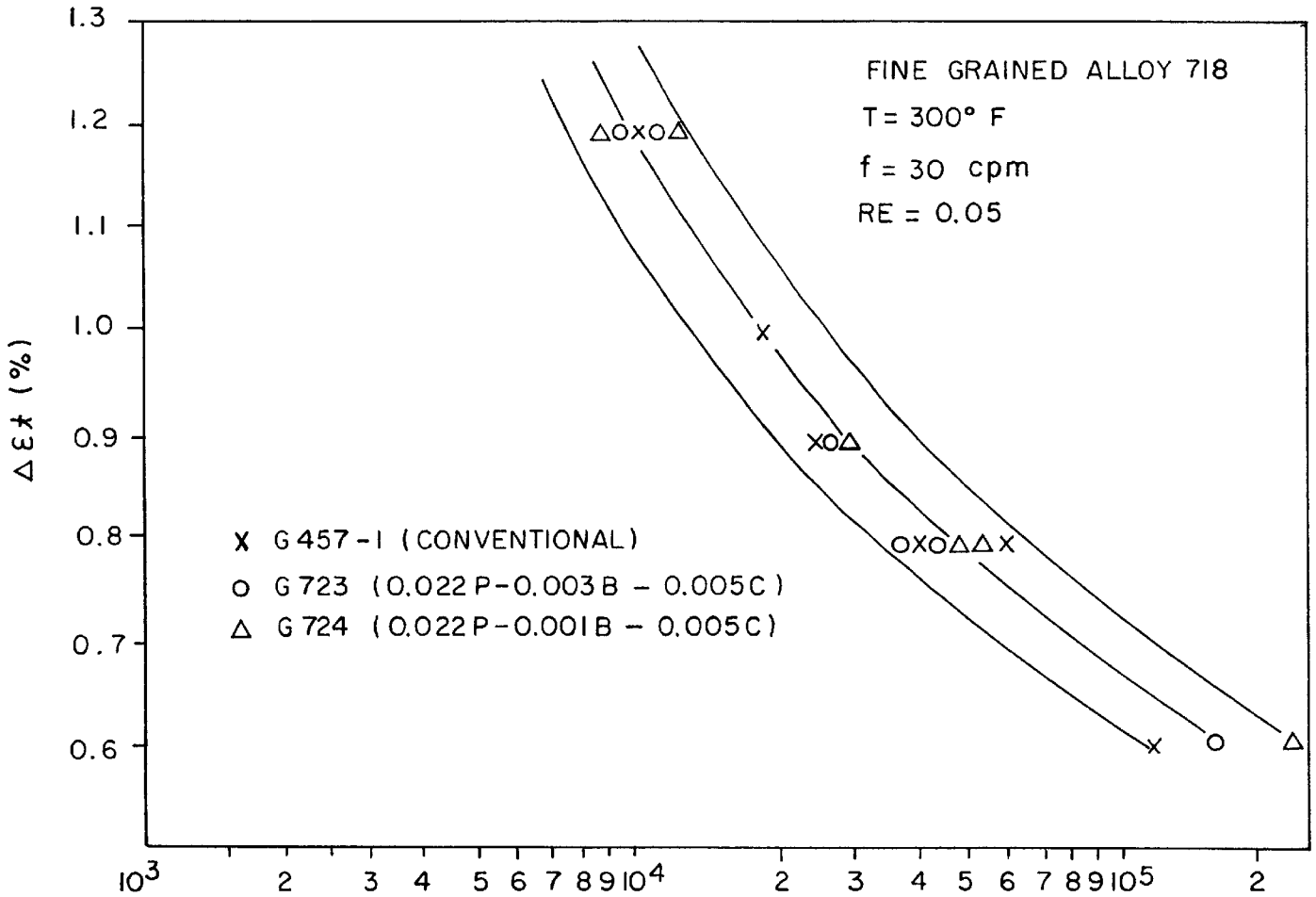
FIG. 6 is a graph showing fatigue resistance data for conventional 718 alloy and alloys according to this invention.

It has also been discovered that still further improvements in rupture life can be obtained by reducing carbon content in conjunction with critical phosphorus and boron contents. This effect is illustrated in Table 1 and FIG. 5.

The invention described clearly demonstrates that phosphorus up to a certain amount substantially improved the stress rupture properties of alloy 718 without degrading the tensile properties and hot workability. The upper limit of phosphorus which could be employed in fine grained alloys was typically much higher than that presently employed or dictated by the 718 specifications. As more fully described herein, the phosphorus-boron interaction provided an ability to selectively achieve desired properties and particularly enhanced stress rupture properties by manipulation of phosphorus and boron levels in nickel-based alloys. It was also observed that a low carbon level was generally beneficial to stress rupture properties in the presence of beneficial amounts of phosphorus and boron.

TABLE I

STRESS RUPTURE PROPERTIES OF TEST ALLOYS

| Heat No. of Test Alloy | Level of Variable Elements (wt %) P | B | C | S/R Properties (1200° F.-100 ksi) Lifetime (HRS) | Elongation (%) | Reduction (%) |
|---|---|---|---|---|---|---|
| G577-1 | 0.0007 | 0.003 | 0.032 | 25.2 | 42.9 | 68.0 |
| G453-1 | 0.0016 | 0.004 | 0.031 | 42.6 | 34.7 | — |
| G455-1 | 0.0016 | 0.004 | 0.032 | 41.8 | 26.5 | 60.0 |
| G454-1 | 0.0016 | <0.001 | 0.030 | 28.9 | 32.7 | — |
| G670-1 | 0.0016 | <0.001 | 0.004 | 26.1 | 29.6 | — |
| G499-1 | 0.0016 | 0.007 | 0.034 | 58.2 | 30.2 | — |
| G498-1 | 0.003 | 0.004 | 0.035 | 184.6 | 27.2 | 45.0 |
| G497-1 | 0.004 | 0.004 | 0.033 | 204.0 | 25.8 | 46.0 |
| G500-1 | 0.008 | 0.004 | 0.035 | 208.0 | 31.7 | 65.0 |
| G671-1 | 0.008 | <0.001 | 0.028 | 24.8 | 36.6 | — |
| G672-1 | 0.009 | 0.005 | 0.013 | 277.5 | 30.3 | — |

TABLE I-continued

STRESS RUPTURE PROPERTIES OF TEST ALLOYS

| Heat No. of Test Alloy | Level of Variable Elements (wt %) P | B | C | S/R Properties (1200° F.-100 ksi) Lifetime (HRS) | Elongation (%) | Reduction (%) |
|---|---|---|---|---|---|---|
| G670-2 | 0.009 | <0.001 | 0.005 | 13.2 | 37.4 | — |
| G729-1 | 0.010 | 0.003 | 0.032 | 217.0 | 30.5 | 68.0 |
| G720 | 0.010 | 0.006 | 0.033 | 300.7 | 22.6 | — |
| G499-2 | 0.010 | 0.007 | 0.037 | 355.0 | 29.3 | — |
| G729-2 | 0.010 | 0.009 | 0.032 | 425.8 | 30.6 | — |
| G721 | 0.013 | 0.005 | 0.005 | 277.5 | 25.7 | — |
| G672-2 | 0.015 | 0.005 | 0.035 | 406.7 | 30.3 | 68.0 |
| G671-2 | 0.023 | 0.004 | 0.028 | 522.8 | 32.0 | 78.0 |
| G726-1 | 0.026 | <0.001 | 0.030 | 241.8 | 25.6 | — |
| G726-2 | 0.024 | 0.007 | 0.032 | 537.1 | 17.0 | — |
| G727-2 | 0.025 | 0.011 | 0.033 | 704.3 | 22.9 | — |
| G723 | 0.020 | <0.001 | 0.005 | 385.5 | 22.0 | — |
| G724 | 0.022 | 0.003 | 0.005 | 660.9 | 20.2 | — |
| G730 | 0.026 | 0.006 | 0.011 | 672.0 | 22.9 | — |
| G727-1 | 0.025 | 0.011 | 0.009 | 749.1 | 22.7 | — |
| G728-2 | 0.033 | 0.004 | 0.033 | 329.8 | 24.3 | 75.0 |
| G728-1 | 0.032 | <0.001 | 0.006 | 57.3 | 24.0 | — |

The contemplated ranges of phosphorus and boron which will achieve the benefit of the invention described herein are 0.012% to 0.050% by weight phosphorus, up to 0.030% by weight boron and where the carbon content is equal to or less than about 0.01% by weight.

It is therefore contemplated that other alloys could advantageously benefit from both phosphorus addition and the phosphorus boron interaction observed.

The following composition embraces the alloys in which it is believed, the described phosphorus boron interaction described herein will be synergistically effective.

TABLE 2

| | |
|---|---|
| 40–55 | Ni |
| 14.5–21 | Cr |
| 2.5–5.5 | Nb + Ta |
| up to 3.3 | Mo |
| 0.65–2.00 | Ti |
| 0.10–0.80 | Al |
| up to .35 | Mn |
| up to 0.07 | C |
| up to 0.015 | S |
| 0.016 to 0.33 | P |
| up to 0.006 | B |
| up to 0.35 | Si |
| Balance | Fe |

We claim:

1. A nickel-based fine grained alloy consisting essentially of

40–55 wt % Ni, 14.5–21 wt % Cr, 2.5–5.5 wt % Nb+Ta, up to 3.3 wt % Mo, 0.65–2.00 wt % Ti, 0.10–0.8 wt % Al, up to 0.35 wt % Mn, up to 0.07 wt % C, up to 0.015 wt % S, up to 0.35 wt % Si, from 0.020 wt % to 0.032 wt % P, from 0.003 wt % to 0.030 wt % B, with the balance Fe and incidental impurities, said alloy being solution heat treated at about 1750° F. for about one hour, followed by aging at about 1325° F. for about eight hours, and having a stress rupture life, when tested at 1200° F. and 100 Ksi, of at least 500 hours.

2. A nickel-based fine grained alloy consisting essentially of

40–55 wt % Ni, 14.5–21 wt % Cr, 2.5–5.5 wt % Nb+Ta, up to 3.3 wt % Mo, 0.65–2.00 wt % Ti, 0.10–0.8 wt % Al, up to 0.35 wt % Mn, up to 0.07 wt % C, up to 0.015 wt % S, up to 0.35 wt % Si, from 0.020 wt % to 0.032 wt % P, from 0.003 wt % to 0.030 wt % B, with the balance Fe and incidental impurities, said alloy having a stress rupture life, when tested at 1200° F. and 100 Ksi, of at least 500 hours, after solution heat treating at about 1750° F. for about one hour followed by aging at about 1325° F. for about eight hours.

* * * * *